US007619501B2

(12) United States Patent
Miura et al.

(10) Patent No.: US 7,619,501 B2
(45) Date of Patent: Nov. 17, 2009

(54) ROTARY VARIABLE RESISTOR AND A METHOD OF ADJUSTING A RESISTOR VALUE OF THE SAME

(75) Inventors: Seiki Miura, Osaka (JP); Jun Sato, Osaka (JP)

(73) Assignee: Panasonic Corporation, Osaka (JP)

( * ) Notice: Subject to any disclaimer, the term of this patent is extended or adjusted under 35 U.S.C. 154(b) by 486 days.

(21) Appl. No.: 11/533,128

(22) Filed: Sep. 19, 2006

(65) Prior Publication Data

US 2007/0063812 A1 Mar. 22, 2007

(30) Foreign Application Priority Data

Sep. 21, 2005 (JP) ..... 2005-273330

(51) Int. Cl.
*H01C 10/32* (2006.01)

(52) U.S. Cl. ..... 338/162

(58) Field of Classification Search ..... 338/162
See application file for complete search history.

(56) References Cited

U.S. PATENT DOCUMENTS 3,676,823 A * 7/1972 Fujii et al. ..... 338/139
5,095,298 A * 3/1992 Chapman et al. ..... 338/162

FOREIGN PATENT DOCUMENTS

JP 2003-124008 4/2003

* cited by examiner

*Primary Examiner*—Elvin G Enad
*Assistant Examiner*—Joselito Baisa
(74) *Attorney, Agent, or Firm*—RatnerPrestia

(57) ABSTRACT

A rotary variable resistor including a rotator having at an upper part a disk-shaped flange provided with a rectangular first adjustment hole penetrating a circumferential portion thereof and at a lower part a cylindrical shaft, and an adjustment plate having a slider at a lower surface thereof and a second adjustment hole with a narrower width than that of the first adjustment hole on an annular flat plate portion. The rotator is integrated into the adjustment plate by fitting the adjustment plate into the shaft of the rotator with adjusting the position of the first adjustment hole with the second adjustment hole. Thus, a rotary variable resistor is configured. After a product is completed, by applying a force from the side of the first adjustment hole to a side wall in the direction of rotation of the second adjustment hole, the adjustment plate can be moved so as to adjust the output voltage ratio.

10 Claims, 6 Drawing Sheets

ROTARY VARIABLE RESISTOR AND A METHOD OF ADJUSTING A RESISTOR VALUE OF THE SAME

TECHNICAL FIELD

The present invention relates to rotary variable resistors used for controlling the temperature of car air conditioners and the image quality and sound volume of video and audio equipment, and the like.

BACKGROUND OF THE INVENTION

Recently, equipment such as a car air conditioner has had higher qualities. Accordingly, rotary variable resistors used for controlling such equipment have been required to output resistance values more precisely.

A conventional rotary variable resistor used for such equipment is described with reference to FIGS. 6 to 7.

FIG. 6 is a sectional view showing a conventional rotary variable resistor; and FIG. 7 is an exploded perspective view thereof. Conventional rotary variable resistor 61 includes case 5 made of an insulating resin, rotator 6 and slider 7.

Case 5 has resistive substrate 1 provided with circular center hole 1A at the center thereof and made of a phenolic paper laminated sheet or a glass epoxy resin laminated sheet. On the upper surface of resistive substrate 1, horseshoe-shaped resistive element 2 is formed at the outer circumferential side and ring-shaped conductive portion 3 is formed at the inner circumferential side of resistive substrate 1. Resistive element 2 and conductive element 3 are concentrically formed by screen printing, and the like. On both ends of resistive element 2 and on a lead provided outwardly from conductive portion 3, terminals 4A, 4B and 4C are fixed to resistive substrate 1 by caulking. Thus, terminals 4A, 4B and 4C are electrically coupled to resistive substrate 1.

Case 5 has fitting hole 5A provided at the center of a cavity with an open top in such a manner in which the position and size of fitting hole 5A is adjusted to those of center hole 1A of resistive substrate 1. Case 5 is formed by insert molding resistive substrate 1 so that resistive element 2 and conductive portion 3 are exposed to the inner bottom surface of the open portion. Therefore, resistive substrate 1 is fixed to case 5, and terminals 4A, 4B and 4C protrude outward from the side wall of case 5, respectively.

Rotator 6 has oval through hole 6A at the center thereof, and includes disk-shaped flange 6B in the upper part thereof and cylindrical shaft 6C in the lower part thereof. To the lower surface of flange 6B, slider 7 is fixed. Slider 7 is brought into sliding contact with resistive element 2 and conductive portion 3 formed on resistive substrate 1. Cylindrical shaft 6C is inserted into center hole 1A of resistive substrate 1 and fitting hole 5A of case 5 from the upper part, and caulked thereto in a state in which a thin-walled lower end portion of cylindrical shaft 6C is expanded outward. Thus, rotator 6 is rotatably combined with case 5.

An operation of rotary variable resistor 61 configured as mentioned above is described. When rotator 6 is operated by using a rotation assisting tool (not shown) inserted into oval through hole 6A of rotator 6, slider 7 fixed to the lower surface of flange portion 6B slides on resistive element 2 and conductive portion 3 of resistive substrate 1. Then, output resistance values corresponding to the contact positions of slider 7 in rotation operation are obtained from terminals 4A, 4B and 4C.

Note here that the above-mentioned conventional technology is disclosed in, for example, Japanese Patent Unexamined Publication No. 2003-124008.

However, in conventional rotary variable resistor 61, due to variation of resistance element portion 2 formed on resistive substrate 1 by printing or deviation in the combination of the components, and the like, deviation between an intended resistance value at a desired rotating angle and a output resistance value is likely to occur.

On the other hand, from manufacturers of vehicle-mounted equipment and AV equipment, there are increasing demands for strict output precision with less deviation. However, when higher precision is intended to be realized, yield is deteriorated, thus increasing the manufacturing cost.

SUMMARY OF THE INVENTION

The present invention addresses the problems discussed above, and aims to provide a highly precise rotary variable resistor having strict output precision with respect to a rotation angle at low cost.

In order to achieve the above-mentioned objects, the rotary variable resistor of the present invention includes a rotator having at an upper part a disk-shaped flange provided with a rectangular first adjustment hole penetrating a circumferential portion thereof and at a lower part a cylindrical shaft; and an adjustment plate having a slider on the lower surface thereof and a second adjustment hole with a narrower width than that of the first adjustment hole on an annular flat plate portion. The rotary variable resistor is configured by integrally combining the rotator and the adjusting plate by fitting the shaft of the rotator into the adjusting plate with the positions of the first adjustment hole and the second adjustment hole adjusted to each other.

After a product is completed, by applying a force from the side of the first adjustment hole to a side wall in the direction of rotation of the second adjustment hole, the adjustment plate can be moved so as to adjust the output. Therefore, it is possible to provide at low cost a highly precise rotary variable resistor by which resistance value output with less deviation from the intended resistance value at a desired rotation angle can be obtained.

Additional objects and advantages of the present invention will be apparent from the following detailed description of preferred embodiments thereof, which are best understood with reference to the accompanying drawings.

DETAILED DESCRIPTION OF THE INVENTION

Figure 1:
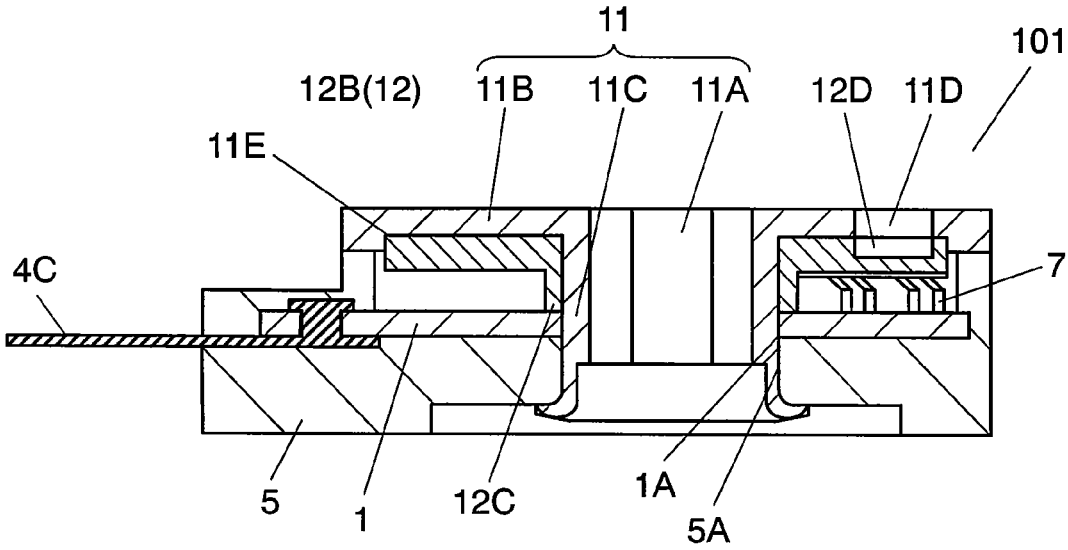
FIG. 1 is a sectional view showing a rotary variable resistor in accordance with an embodiment of the present invention.

Hereinafter, the embodiment of the present invention is described with reference to FIGS. 1 to 5.

Note here that the same reference numerals are given to the same configurations described in "Background of the Invention" and the description therefore is simplified.

Embodiment

Figure 2:
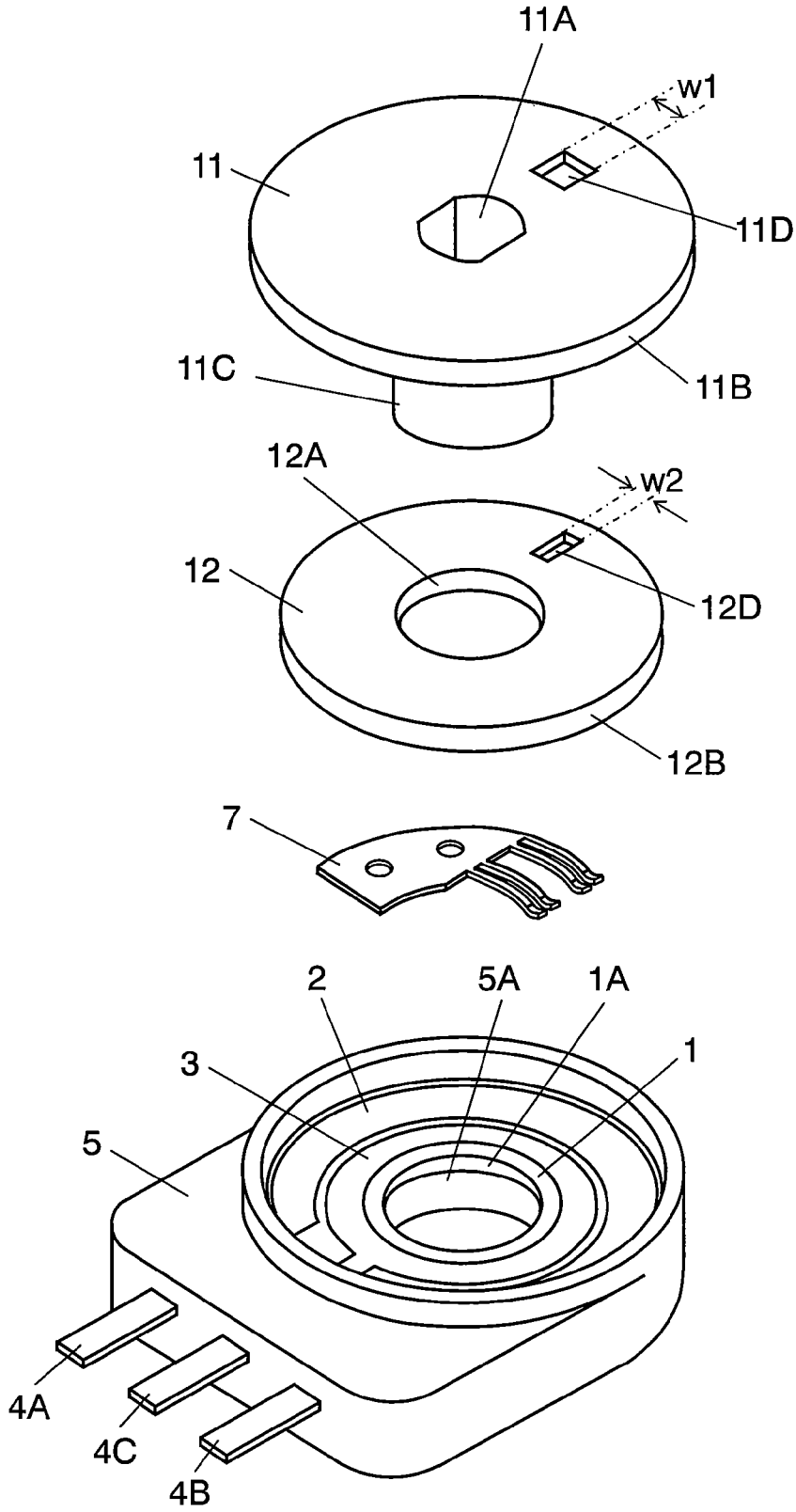
FIG. 2 is an exploded perspective view showing a rotary variable resistor in accordance with an embodiment of the present invention.
Figure 3:
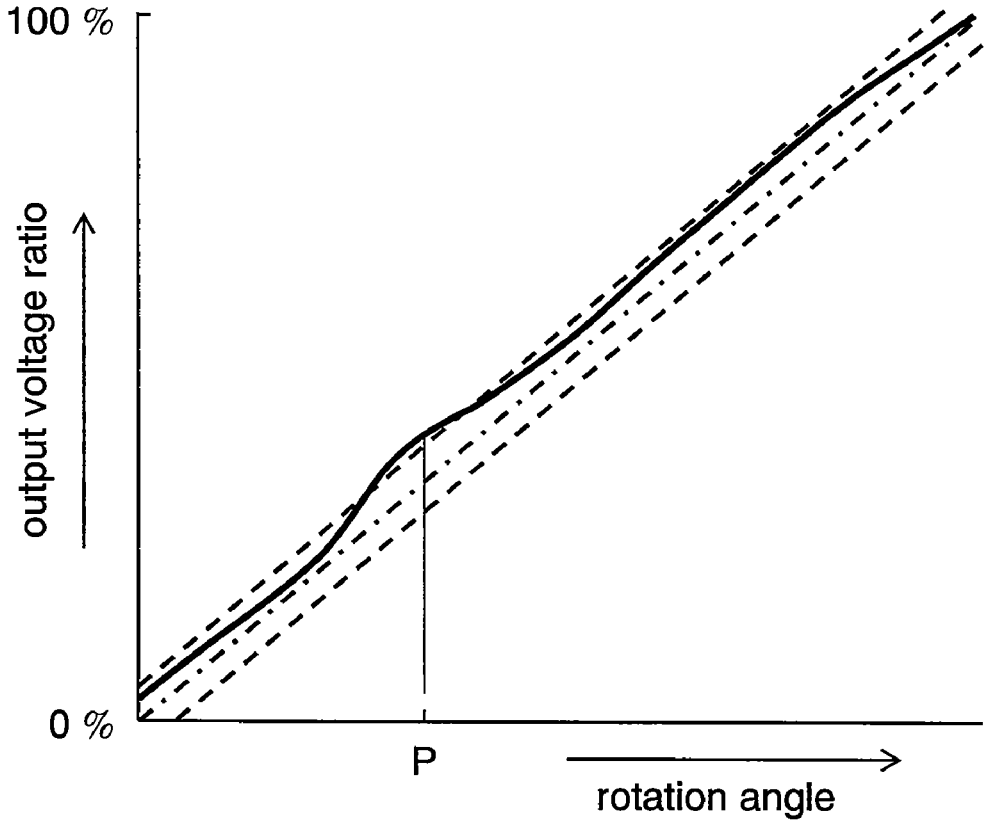
FIG. 3 is a graph showing a curve of the change in resistance.
Figure 4A:
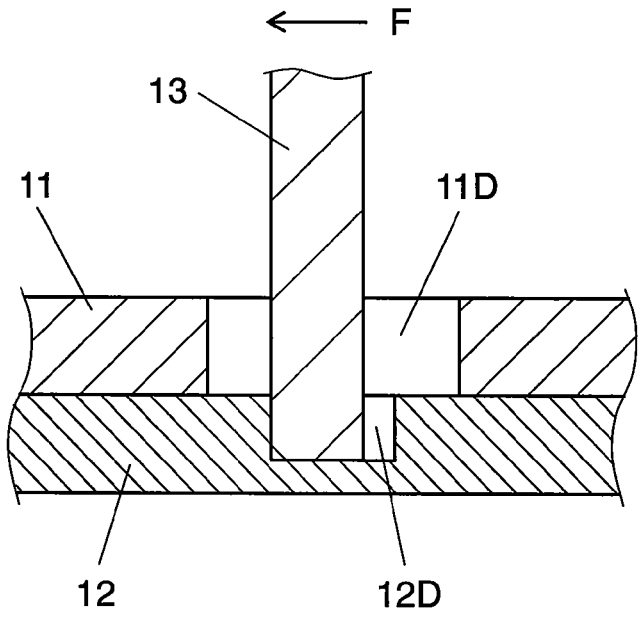
FIGS. 4A and 4B are partial sectional views showing a state of adjusting an adjustment plate.
Figure 4B:
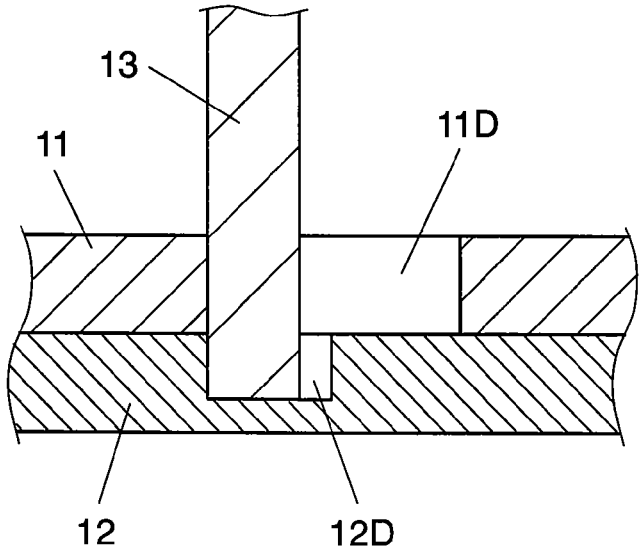

FIG. 1 is a sectional view showing a rotary variable resistor in accordance with an embodiment of the present invention; FIG. 2 is an exploded perspective view thereof, FIG. 3 is a graph showing a curve of the change in resistance; and FIGS. 4A and 4B are partial sectional views showing a state of adjusting an adjustment plate.

Rotary variable resistor 101 in accordance with this embodiment includes case 5, rotator 11, slider 7 and adjustment plate 12.

Case 5 has resistive substrate 1 provided with circular center hole 1A at the center thereof and made of a phenolic paper laminated sheet, a glass epoxy resin laminated sheet, or the like. On the upper surface of resistive substrate 1, horseshoe-shaped resistive element 2 and ring-shaped conductive portion 3 formed at the inner side of the resistive element 2 are concentrically formed by screen printing, and the like. Terminals 4A and 4B are fixed by caulking to both ends of resistive element 2. Furthermore, terminal 4C is fixed by caulking to a lead provided toward the outside from conductive portion 3. Terminals 4A and 4B and terminal 4C, which are fixed by caulking, are electrically coupled to resistive substrate 1, respectively.

Case 5 is made of an insulating resin. Resistive substrate 1 is fixed to case 5 by insert molding. Resistive element 2 and conductive portion 3 are exposed to the inside of a cavity with open top. Case 5 has circular fitting hole 5A provided in its center. The position and size of fitting hole 5A are adjusted to those of center hole 1A of resistive substrate 1. Terminals 4A, 4B and 4C protrude outward from the side wall of case 5.

Rotator 11 has oval through hole 11A at the center thereof. Rotator 11 includes disk-shaped flange 11B on the upper part thereof and cylindrical shaft 11C protruding downward at the center thereof. On the peripheral portion of flange 11B, penetrating rectangular first adjustment hole 11D having first width w1 is provided. Furthermore, on the lower surface of flange 11B, annular concave portion 11E is provided. Further, the lower end portion of shaft 11C is formed thinly.

Adjustment plate 12 includes annular flat plate portion 12B and cylindrical skirt portion 12C. At the center of flat plate portion 12B, circular center through hole 12A is provided. To the lower surface of flat plate portion 12B, slider 7 is fixed. Slider 7 slides on resistive element 2 and conductive portion 3 exposed to the open portion of case 5. Furthermore, cylindrical skirt portion 12C protrudes downward in such a manner as to surround center through hole 12A.

On flat plate portion 12B of adjustment plate 12, a rectangular-shaped cavity having second width w2 in the direction of rotation is provided as second adjustment hole 12D. Second adjustment hole 12D is formed so that its position with respect to the rotation center is matched to that of first adjustment hole 11D provided on flange 11B of rotator 11. Second width w2 of second adjustment hole 12D is set to be thinner than first width w1 of first adjustment hole 11D. The positions of second adjustment hole 12D and first adjustment hole 11D are adjusted in the radial direction, and the center positions of the rectangular shapes are adjusted in the direction of the rotation. In this a state, shaft 11C is press-fitted into center through hole 12A. Thereby, adjustment plate 12 is integrally combined with rotator 11. In the combined state, adjustment plate 12 sinks into the lower surface of flange 11B by a depth of annular concave portion 11E as shown in FIG. 1.

Then, shaft 11C of rotator 11, which protrudes downward from center through hole 12A of adjustment plate 12, is inserted into center hole 1A of resistive substrate 1 and fitting hole 5A of case 5 and caulked to the bottom surface of case 5 in a state in which the thin-walled lower end portion of shaft 11C is expanded outward. Thus, rotator 11 is rotatably combined with the case 5.

Note here that adjustment plate 12 is combined with concave portion 11E on the lower surface of rotator 11 in the direction of sinking (upward direction in FIG. 2). Therefore, the increase in the dimension in the thickness direction caused by the addition of adjustment plate 12 can be suppressed.

Hereinafter, an operation of rotary variable resistor 101 configured as mentioned above is described. When rotator 11 is rotated by using a rotation assisting tool and the like (not shown) inserted into oval through hole 11A of rotator 11, rotator 11 and adjustment plate 12 that is integrated with rotator 11 start to be rotated. At this time, slider 7 fixed to the lower surface of adjustment plate 12 slides on resistive element 2 and conductive portion 3, which are formed on the upper surface of resistive substrate 1. Thereby, output resistance values corresponding to the rotation angle position are output from between terminals 4A and 4C and between terminals 4B and 4C.

Next, with reference to FIGS. 3 and 4, a method of adjusting the output precision with respect to a rotation angle in rotary variable resistor 101 in accordance with the present invention is described.

FIG. 3 is a graph showing a curve of the change in resistance. In this graph, the abscissa indicates a rotation angle and the ordinate indicates output voltage ratio. Alternate long and short dashed line indicates the intended curve of the change in resistance, a solid line indicates an actual measurement value, and a range between broken lines indicates tolerance. Herein, the output voltage ratio is expressed as a percentage of the output voltage between terminals 4A and 4C with respect to the input voltage between terminals 4A and 4B.

Position P shown in FIG. 3 indicates a case where the output voltage ratio (resistance value output) at a predetermined rotation angle deviates from the tolerance due to variation of components, deviation by the combination, or the like. In such a case, as shown in FIG. 4A, by inserting thin and narrow adjuster 13 such as a flat blade screwdriver capable of passing from the upper part of rotator 11 through first adjustment hole 11D and reaching the inside of second adjustment hole 12D of adjustment plate 12, force F in the direction of rotation (direction indicated by the arrow) is applied toward the side wall at the side of the direction of rotation of second adjustment hole 12D. Since adjustment plate 12 and rotator 11 were fitted into each other with a predetermined fitting strength in advance, when force F that is beyond the predetermined fitting strength is applied, as shown in FIG. 4B, second adjustment hole 12D with narrow line width is shifted within the first width of first adjustment hole 11D, and thereby adjustment plate 12 is rotated with respect to rotator 11. Note here that FIG. 4A shows a state in which adjustment plate 12 is located in the first position with respect to rotator 11; and FIG. 4B shows a state in which adjustment plate 12 is located in the second position with respect to rotator 11. FIG. 4B shows an example in which adjustment plate 12 is moved to the left direction with respect to rotator 11. On the contrary, it can be moved to the right direction.

That is to say, adjustment plate 12 can be moved with respect to rotator 11 in relative to the rotation direction from the first position to the second position in a state in which shaft 11C is press-fitted in center through hole 12A. With a relative movement of both, a position in which slider 7 fixed to adjustment plate 12 is brought into contact with resistive element 2 and conductive portion 3 is moved and output voltage ratio (resistance value output) is changed. Thus, the curve of the change in resistance can be fallen within the tolerance of deviation.

It is necessary that the press-fitting strength of adjustment plate 12 into rotator 11 be a strength which does not allow adjustment plate 12 to be rotated by a load applied when slider 7 slides and which allows adjustment plate 12 to be rotated by a load applied to second adjustment hole 12D by adjuster 13 from the outside. The fitting strength may be controlled by changing the length of the fitted portion or by changing the difference of the diameter between the shaft 11C and center through hole 12A. One method of adjusting this fitting strength includes a method of changing a depth dimension in which adjustment plate 12 sinks into annular concave portion 11E provided on the lower surface of rotator 11. That is to say, when the depth at which adjustment plate 12 sinks into concave portion 11E is increased, the fitting strength can be increased. On the contrary, when the depth at which adjustment plate 12 sinks into concave portion 11E is reduced, the fitting strength can be reduced. Furthermore, another method may include a method of gradually changing the diameter of shaft 11C according to the position in the axial direction of shaft 11C. That is to say, by moving up and down the position in the axial direction of rotator 11 in shaft 11C, the fitting strength can be adjusted. Thus, an appropriate pressing fitting state can be realized.

Note here that the adjustment of adjustment plate 12 with respect to rotator 11 may be carried out in the left direction (direction indicated by the arrow in FIG. 4A) or in the right direction (opposite direction indicated by the arrow in FIG. 4A) in accordance with the increase and decrease with respect to a desired output voltage ratio (resistance value output).

That is to say, in rotary variable resistor 101 in accordance with this embodiment, center through hole 12A of adjustment plate 12 is combined with shaft 11C of rotator 11 in a press-fitted state. When rotator 11 is rotated, adjustment plate 12 can be rotated together with rotator 11. When a load that is predetermined value or more is applied to second adjustment hole 12D from the outside, adjustment plate 12 is allowed to be rotated with respect to rotator 11. With this configuration, adjustment plate 12 is moved by applying a force in the direction of rotation to the side wall of second adjustment hole 12D in adjustment plate 12 at the side of the rotation direction through the first adjustment hole 11D of rotator 11 so as to change a contact position of slider 7 on resistive element 2. Thereby, the output voltage ratio (resistance value output) can be adjusted easily.

With this adjustment, deviation of resistance value output due to variation of components or variation of combination thereof can be easily revised after a rotary variable resistor is assembled. Therefore, the rotary variable resistors with high precision can be realized at low cost.

Note here that when a cavity is used as second adjustment hole 12D formed on the surface of flat plate portion 12B, instead of using a through hole as second adjustment hole 12D, dust, etc. does not enter the surface of resistive substrate 1 from second adjustment hole 12D. Thus, a dust proof property can be maintained and a contact property can be stabilized for a long time.

Furthermore, in adjustment plate 12, center through hole 12A is combined with shaft 11C of rotator 11 in a press-fitted state. Furthermore, the outer circumferential surface of flat plate portion 12B of adjustment plate 12 may be press-fitted to the outer circumferential wall of concave portion 11E provided on the lower surface of flange portion 11B of rotator 11. Thus, also after adjustment plate 12 is adjusted, a press-fitting state of adjustment plate 12 can be stabilized.

Figure 5:
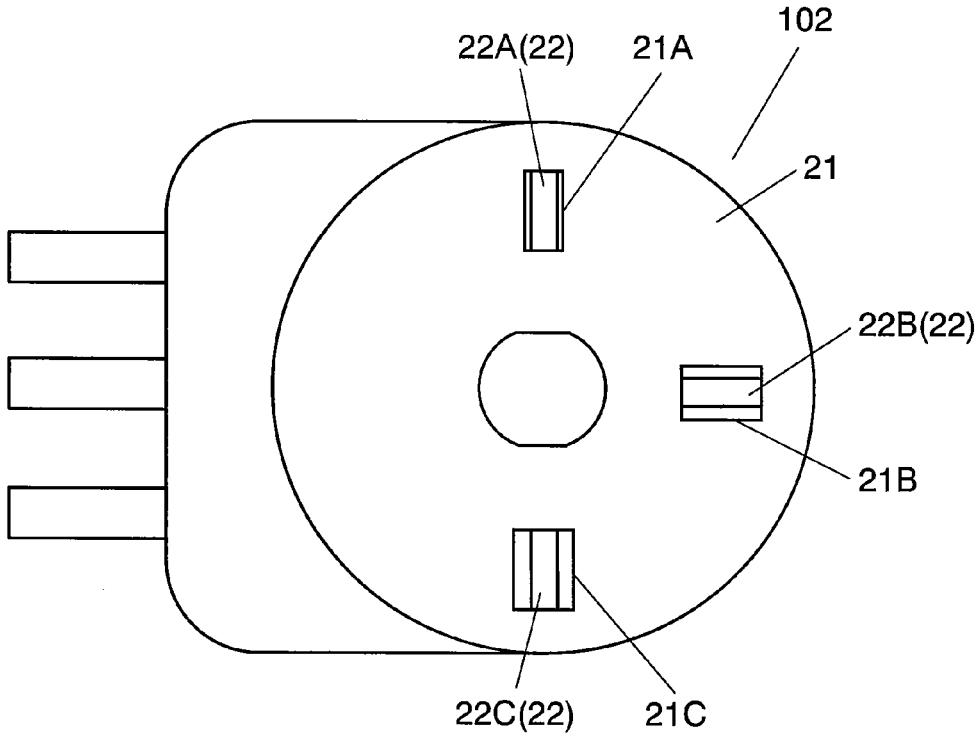
FIG. 5 is a plan view showing a rotary variable resistor provided with a plurality of adjusting holes in accordance with an embodiment of the present invention.
Figure 6:
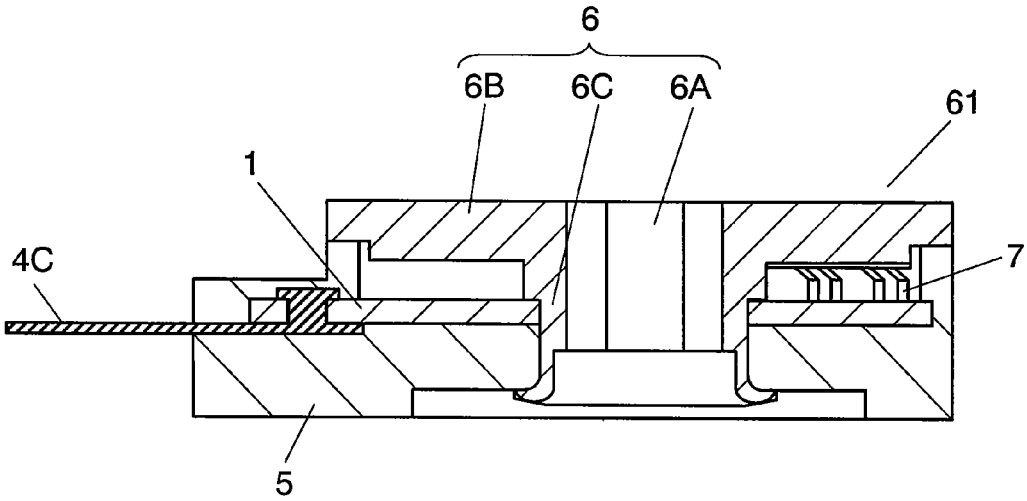
FIG. 6 is a sectional view showing a conventional rotary variable resistor.
Figure 7:
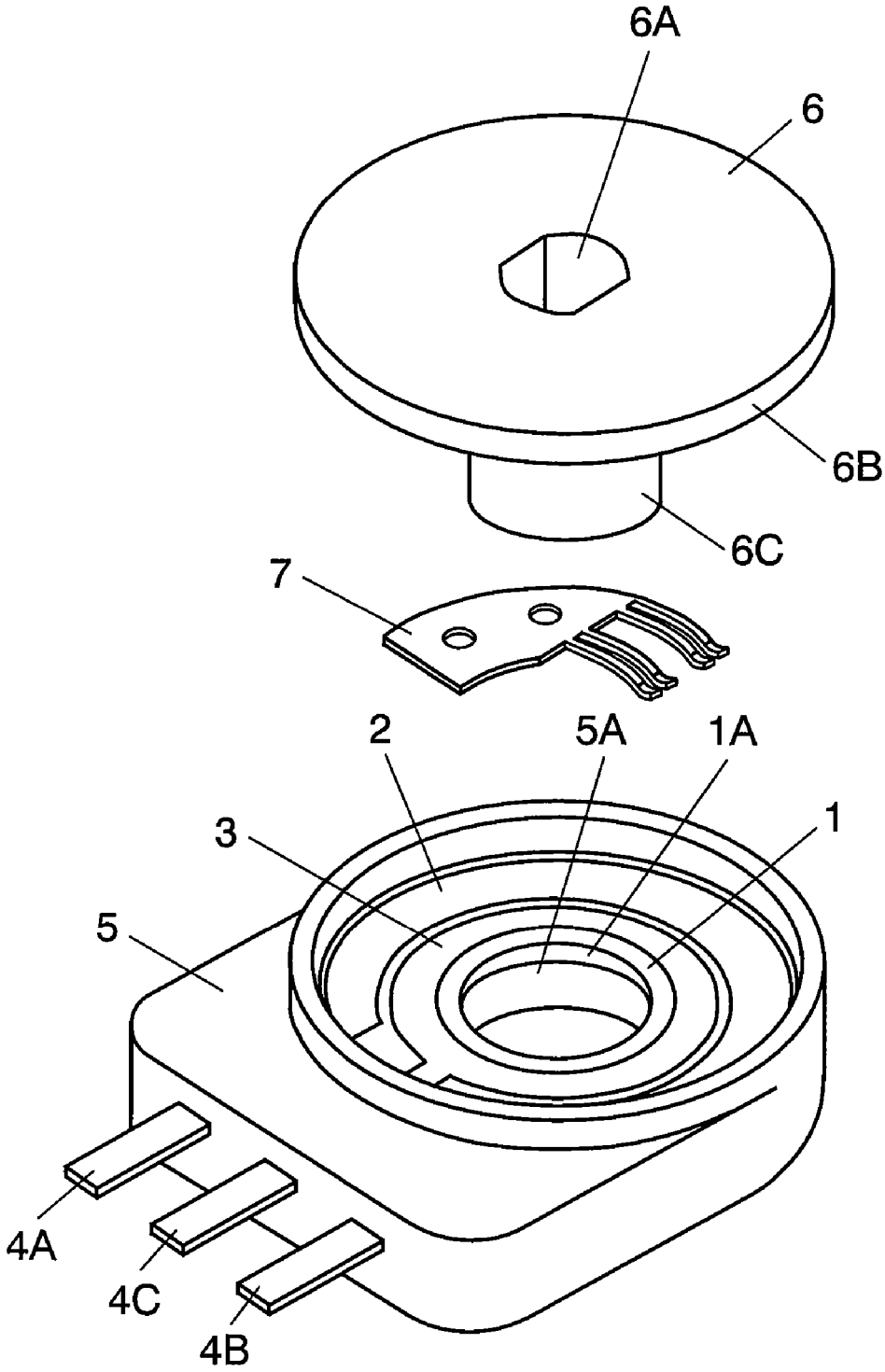
FIG. 7 is an exploded perspective view showing a conventional rotary variable resistor.

Furthermore, as shown in FIG. 5, rotator 21 and adjustment plate 22 may be provided with a plurality of adjustment holes, respectively. Rotary variable resistor 102 includes first adjustment holes 21A, 21B, and 21C of rotator 21 in three portions at an interval of 90 degrees. Adjustment plate 22 is also provided with second adjustment holes 22A, 22B, and 22C in three positions corresponding to three first adjustment holes 21A, 21B and 21C.

Then, each of first adjustment holes 21A, 21B and 21C provided in three portions is set to be gradually wider in the direction of rotation compared with each of the corresponding second adjustment holes 22A, 22B and 22C provided in three portions. That is to say, the difference in the width in the direction of rotation between first adjustment holes 21A, 21B and 21C and second adjustment holes 22A, 22B and 22C can be set to difference in the width which enables ±1%, ±2% and ±3% of adjustment of the output voltage ratio. When the difference of the width is set in this way, by using the adjustment hole adapted to the degree of the deviation from the intended output voltage ratio (resistance value output), adjustment plate 22 is rotated. Then, the position in which slider 7 is brought into contact with resistive element 2 is changed so as to adjust the deviation. Thus, the output can be adjusted to the intended output without much time and labor.

Furthermore, in FIG. 5, the combination of adjustment holes provided in three portions is described as an example, the number of adjustment holes and the difference in width may be appropriately increased and decreased in accordance with product forms, configuration, and the like.

A rotary variable resistor in accordance with the present invention has a feature in that a highly precise rotary variable resistor by which resistance value output that is little deviated from the intended resistance value is obtained at a desired rotation angle can be provided at low cost. The rotary variable resistor in accordance with the present invention is useful for controlling the temperature of car air conditioners and the image quality and sound volume of video and audio equipment, and the like.

It will be obvious to those skilled in the art that various changes may be made in the above-described embodiments of the present invention. However, the scope on the present invention should be determined by the following claims.

What is claimed is:

1. A rotary variable resistor comprising:

a case having a fitting hole and holding a resistive substrate, which has a resistive element and a conductive portion on its upper surface;

a rotator including a disk-shaped flange provided with a first adjustment hole and a shaft protruding to a lower part of the flange, the shaft being inserted into the fitting hole of the case and rotatably attached thereto;

an adjustment plate having a substantially flat annular shape with a through hole at a center thereof, in which the through hole is combined with the shaft of the rotator in a press-fitted state with a position of a second adjustment hole adjusted to a position of the first adjustment hole, the second adjustment hole being provided in a position with respect to a rotation center, which is the same as in the first adjustment hole, and having a width in the direction of rotation that is narrower than a width of the first adjustment hole; and a slider provided on a lower surface of the adjustment plate and sliding on the resistive element and the conductive portion, wherein when the rotator is rotated, the adjustment plate is rotated together with the rotator, and the through hole of the adjustment plate is combined with the shaft of the rotator in a press-fitted state in a manner in which the adjustment plate can be rotated relatively to the rotator by a load applied to the second adjustment hole from the outside at the first adjustment hole.

2. The rotary variable resistor of claim 1, wherein plural sets of the first adjustment holes and the second adjustment holes are provided, and a difference of the width in a direction of rotation in the plural sets is stepwisely provided between the first adjustment hole and the second adjustment hole.

3. The rotary variable resistor of claim 1, wherein the second adjustment hole is a cavity.

4. The rotary variable resistor of claim 1, wherein the flange is provided with a concave portion on a lower surface, the adjustment plate has a circular shape, and an outer circumferential surface of the adjustment plate is combined with an outer circumferential wall of the concave portion.

5. A rotary variable resistor, comprising:

a case having a fitting hole and holding a resistive substrate, which has a resistive element and a conductive portion on its upper surface;

a rotator including a disk-shaped flange and a shaft extending downward from a center of the flange, the shaft being inserted into the fitting hole, and the rotator being rotatably attached to the case;

a flat annular adjustment plate disposed between the rotator and the case, the adjustment plate being provided with a through hole at its center and the shaft being press-fitted into the through hole; and a slider fixed to a lower surface of the adjustment plate and sliding on the resistive element and the conductive portion, wherein a first adjustment hole having a first width in a direction of rotation is pierced in the flange of the rotator, and a second adjustment hole having a second width in the direction of rotation, which is narrower than the first width, is provided on a position corresponding to the first adjustment hole of the adjustment plate.

6. The rotary variable resistor of claim 5, wherein the adjustment plate is held by the rotator, and when a force is applied to a side surface of the second adjustment hole, the adjustment plate can move from a first position to a second position in the direction of rotation with respect to the rotator.

7. The rotary variable resistor of claim 6, wherein the force is a force beyond a load applied to the adjustment plate when the slider slides on the resistive element and the conductive portion.

8. The rotary variable resistor of claim 6, wherein the shaft has a diameter changing depending upon a position in the axial direction, and the fitting strength is changed depending upon a position in which the through hole is engaged in the shaft.

9. The rotary variable resistor of claim 5, wherein the rotator has an annular concave portion on a lower surface of the flange, and an outer circumference of the adjustment plate is fitted into the concave portion and a dimension by which the adjustment plate sinks into the concave portion is adjustable.

10. A method of adjusting a resistor value of a rotary variable resistor, the rotary variable resistor comprising:

a case having a fitting hole and holding a resistive substrate, which has a resistive element and a conductive portion on its upper surface;

a rotator including a disk-shaped flange and a shaft extending downward from a center of the flange, the shaft being inserted into the fitting hole, and the rotator being rotatably attached to the case;

a flat annular adjustment plate disposed between the rotator and the case, the adjustment plate being provided with a through hole at its center and the shaft being press-fitted into the through hole; and a slider provided on a lower surface of the adjustment plate and sliding on the resistive element and the conductive portion, wherein a first adjustment hole having a first width in a direction of rotation is pierced in the flange of the rotator, and a second adjustment hole having a second width in the direction of rotation, which is narrower than the first width, is provided on a position corresponding to the first adjustment hole of the adjustment plate, and the method comprising:

inserting an adjuster into the second adjustment hole through the first adjustment hole, applying a force to a side surface of the second adjustment hole, thereby moving the adjustment plate about the press-fitted shaft and with respect to the rotator from a first position to a second position in the direction of rotation.

* * * * *